US009131732B1

(12) United States Patent
Hoffius

(10) Patent No.: US 9,131,732 B1
(45) Date of Patent: Sep. 15, 2015

(54) NON-ADDICTIVE SMOKING COMPOSITION AND CORN-COB PIPE KIT

(76) Inventor: Gerald Hoffius, Willow Grove, PA (US)

( * ) Notice: Subject to any disclaimer, the term of this patent is extended or adjusted under 35 U.S.C. 154(b) by 790 days.

(21) Appl. No.: 13/474,946

(22) Filed: May 18, 2012

(51) Int. Cl.
*A24B 15/16* (2006.01)
*A24F 5/00* (2006.01)

(52) U.S. Cl.
CPC .. *A24F 5/00* (2013.01); *A24B 15/16* (2013.01)

(58) Field of Classification Search
None
See application file for complete search history.

(56) References Cited

U.S. PATENT DOCUMENTS

| | | | | |
|---|---|---|---|---|
| 3,559,655 | A * | 2/1971 | Briskin et al. | 131/359 |
| 3,782,392 | A * | 1/1974 | Monte | 131/355 |
| 3,964,495 | A | 6/1976 | White | |
| 4,058,129 | A | 11/1977 | Beringer et al. | |
| 5,229,120 | A | 7/1993 | DeVincent | |
| 5,234,008 | A * | 8/1993 | Fagg | 131/297 |
| 6,440,223 | B1 | 8/2002 | Dube et al. | |

* cited by examiner

*Primary Examiner* — Michael J Felton
(74) *Attorney, Agent, or Firm* — Crossley Patent Law

(57) ABSTRACT

A non-addictive smoking composition and corn-cob pipe kit including a mixture of dried corn silk strands and dried corn cob leaves in a range of approximately 80-90% and 10-20%, respectively, by volume, of the mixture to provide a nicotine-free, non-addictive smoking alternative. The kit also includes a smoking pipe having structural components to resemble a corn-cob pipe. The pipe has a detachable tube, stem, and mouthpiece.

6 Claims, 2 Drawing Sheets

FIG. 1
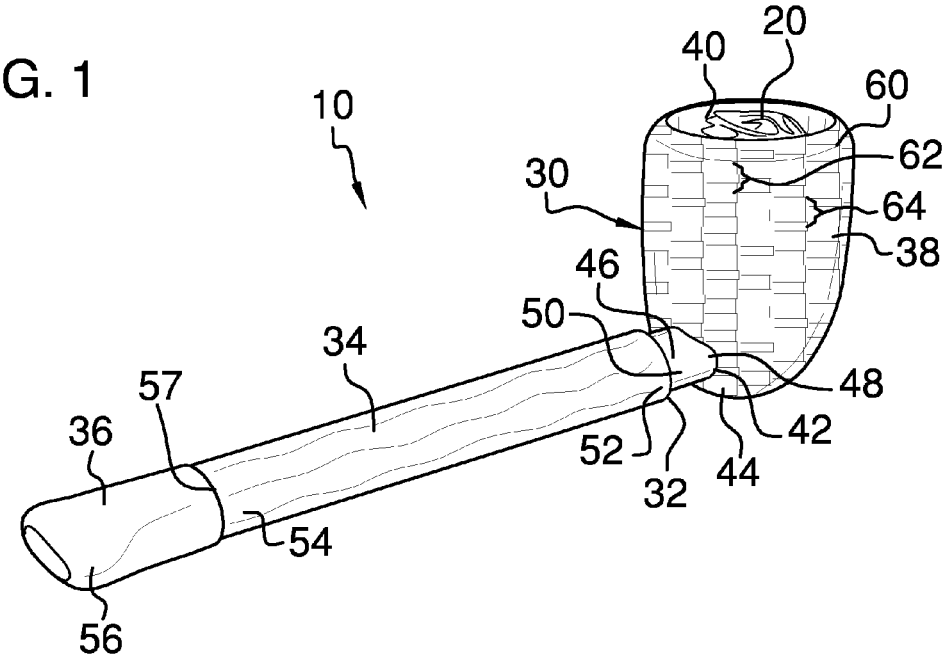
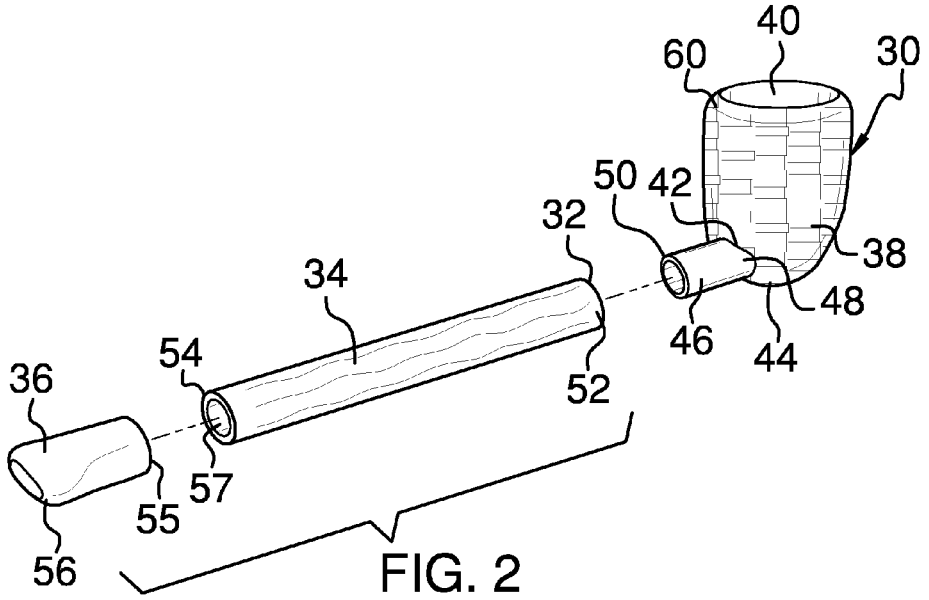
FIG. 2

NON-ADDICTIVE SMOKING COMPOSITION AND CORN-COB PIPE KIT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of smoking pipes and tobacco substitutes for smoking are known in the prior art. However, what is needed is a non-addictive smoking composition and corn-cob pipe kit that provides a nicotine-free, non-additive smoking product alternative to tobacco and other addictive smoking products and also provides a smoking pipe that encourages a user to smoke the smoking product.

FIELD OF THE INVENTION

The present invention relates to smoking products and smoking pipes, and more particularly, to a non-addictive smoking composition and corn-cob pipe kit.

SUMMARY OF THE INVENTION

The general purpose of the present non-addictive smoking composition and corn-cob pipe kit, described subsequently in greater detail, is to provide a non-addictive smoking composition and corn-cob pipe kit which has many novel features that result in a non-addictive smoking composition and corn-cob pipe kit which is not anticipated, rendered obvious, suggested, or even implied by prior art, either alone or in combination thereof.

To accomplish this, the present non-addictive smoking composition and corn-cob pipe kit is provided as a nicotine-free, non-addictive smoking alternative that serves the needs of a smoker without the health risks associated with smoking products that contain addictive substances, such as nicotine. The kit includes a mixture of an amount of dried corn silk strands and an amount of dried corn cob leaves, rather than tobacco or other addictive smoking products. The amounts of dried corn silk strands and dried corn cob leaves are in a range of approximately 80% to 90% and 10% to 20%, respectively, by volume of the mixture. The mixture is configured to be placed in a bowl of a smoking pipe and smoked followed by being lighted in the bowl and smoked through a stem of the smoking pipe and out of a mouthpiece thereof.

The bowl has a continuous exterior wall and a cavity centrally disposed within the exterior wall along a longitudinal midline thereof. An aperture is disposed through the exterior wall proximal to a bottom end thereof to permit passage of smoke from the lighted mixture to pass into and through a cylindrical tube that has a first end extending into the cavity and a second end. An elongated cylindrical stem, also a part of the smoking pipe, has a proximal end removably, slidably attached to the second end, which permits the stem to be detached from the smoking pipe for cleaning, and a distal end. A continuous opening is centrally disposed through the stem to permit the passage of smoke from the lighted mixture to pass therethrough. A hollow substantially cylindrical mouthpiece has an attachment end removably, slidably attached to the stem distal end to permit detachment of the mouthpiece for cleaning and also a tapered outer end. The outer end is tapered to provide a comfortable fit into a smoking user's mouth as opposed to a non-tapered outer end. The stem has a larger diameter than a diameter of the tube. The mouthpiece attachment end has a larger diameter than a diameter of the stem distal end. Thus, the stem and the mouthpiece are slidingly separable from the smoking pipe for cleaning. The smoking pipe can be a corn-cob pipe as illustrated. The exterior wall of the corn-cob pipe bowl includes a plurality of first rectangles and a plurality of second rectangles thereon. Each of the first rectangles has a smaller surface area than a surface area of the second rectangles. Each of the first rectangles and the second rectangles are interspersed on the exterior wall. The interspersion of the first rectangles and the second rectangles on the exterior wall is configured to resemble a corn cob. The corn-cob pipe resembles a corn cob in order to encourage a user to smoke the instant mixture, rather than tobacco or other addictive smoking products, to reduce health risks associated with tobacco.

The instant mixture can also be used as an alternative to tobacco in a cigarette. Thus, a user can prepare his own cigarette using the instant mixture as a non-addictive alternative to tobacco.

Thus has been broadly outlined the more important features of the present non-addictive smoking composition and corn-cob pipe kit so that the detailed description thereof that follows may be better understood and in order that the present contribution to the art may be better appreciated.

BRIEF DESCRIPTION OF THE DRAWINGS

Figures

FIG. 1 is an isometric view of a pipe.
FIG. 2 is an exploded view of the pipe.

DETAILED DESCRIPTION OF THE DRAWINGS

Figure 3:
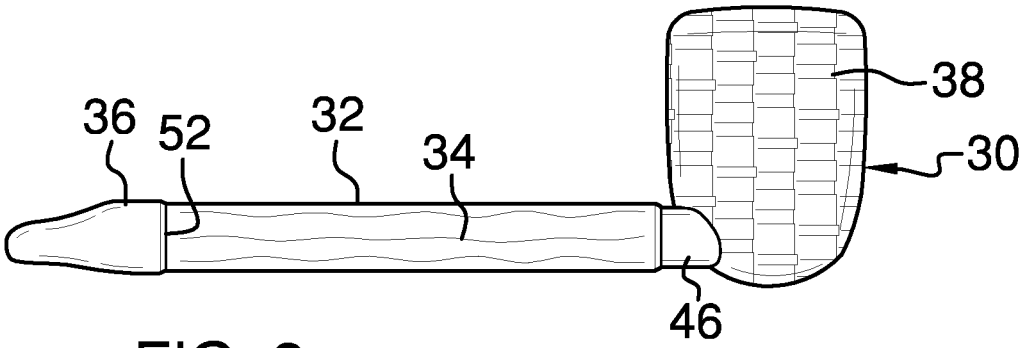
FIG. 3 is a side elevation view of the pipe.
Figure 4:
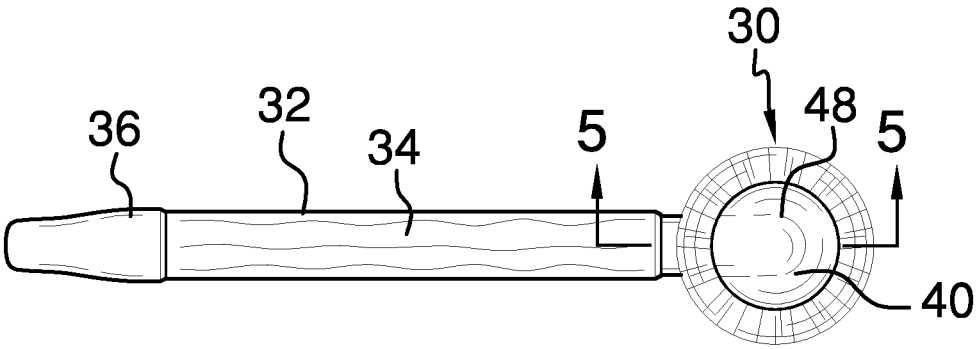
FIG. 4 is a top plan view of the pipe.
Figure 5:
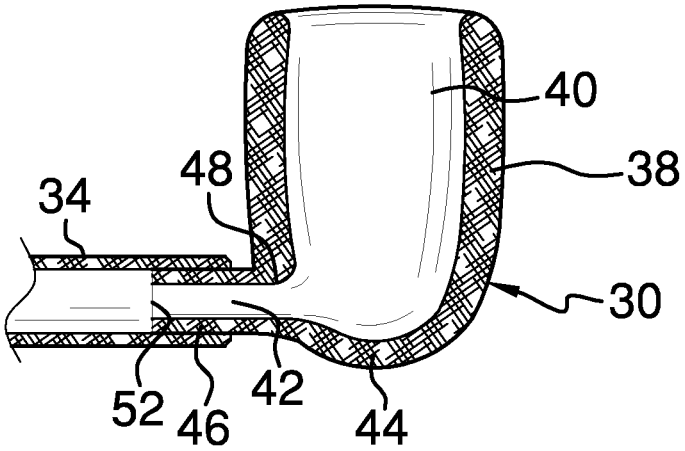
FIG. 5 is a cross-sectional view taken along line 5-5 of FIG. 4.

With reference now to the drawings, and in particular FIGS. 1 through 5 thereof, example of the instant non-addictive smoking composition and corn-cob pipe kit employing the principles and concepts of the present non-addictive smoking composition and corn-cob pipe kit and generally designated by the reference number 10 will be described. Referring to FIGS. 1 through 5 a preferred embodiment of the present non-addictive smoking composition and corn-cob pipe kit 10 is illustrated. The non-addictive smoking composition and corn-cob pipe kit 10 is provided as a nicotine-free, non-addictive smoking alternative that serves the needs of a smoker without the health risks associated with smoking products that contain addictive substances, such as nicotine.

The kit 10 includes a mixture 20 of an amount of dried corn silk strands and an amount of dried corn cob leaves, rather than tobacco or other addictive smoking products. The amount of dried corn silk strands is in a range of approximately 80% to 90% by volume of the mixture 20. The amount of dried corn cob leaves is in a range of 10% to 20% by volume of the mixture 20. The mixture 20 is configured to be placed in a bowl 30 of a smoking pipe 32 and smoked followed by being lighted in the bowl 30 and smoked through a stem 34 of the smoking pipe 32 and out of a mouthpiece 36 thereof.

The bowl 30 has a continuous exterior wall 38 and a cavity 40 centrally disposed within the exterior wall 38 along a longitudinal midline thereof. The bowl 30 is configured to contain the mixture 20 therein. An aperture 42 is disposed through the exterior wall 38 proximal to a bottom end 44 thereof. The smoking pipe 32 also includes a cylindrical tube 46 that has a first end 48 extending into the cavity 40 and a second end 50. An elongated cylindrical stem 34, also a part of the smoking pipe 32, has a proximal end 52 removably, slidably attached to the second end 50, which permits the stem 34 to be detached from the smoking pipe 32 for cleaning, and a distal end 54. A continuous opening 57 is centrally disposed through the stem 34. A hollow mouthpiece 36 has a substantially cylindrical attachment end 55 removably, slidably attached to the stem 34 distal end 54 to permit detachment of the mouthpiece 36 for cleaning. The mouthpiece 36 also a tapered outer end 56. The outer end 56 is tapered to provide a comfortable fit into a smoking user's mouth as opposed to a non-tapered outer end. The stem 34 has a larger diameter than the diameter of the tube 46. The mouthpiece 36 attachment end 55 has a larger diameter than the diameter of the stem 34 distal end 54.

The smoking pipe 32 can be a corn-cob pipe 60 as illustrated. The exterior wall 38 of the corn-cob pipe 60 bowl 30 includes a plurality of first rectangles 62 and a plurality of second rectangles 64 thereon. Each of the first rectangles 62 has a smaller surface area than a surface area of a second rectangle 64. Each of the first rectangles 62 and the second rectangles 64 are interspersed on the exterior wall 38. The interspersion of the first rectangles 62 and the second rectangles 64 on the exterior wall 38 is configured to resemble a corn cob. The corn-cob pipe 60 resembles a corn cob in order to encourage a user to smoke the instant mixture 20, rather than tobacco or other addictive smoking products, to reduce health risks associated therewith.

What is claimed is:

1. A non-addictive smoking composition and corn-cob pipe kit comprising:

a smoking pipe having a bowl;

a mixture of an amount of dried corn silk strands and an amount of dried corn cob leaves; and wherein the mixture is configured to be placed and lighted in the bowl of the smoking pipe and smoked therefrom by a user; and wherein the amount of dried corn silk strands is in a range of approximately 80% to 90% by volume of the mixture; and wherein the amount of dried corn cob leaves is in a range of 10% to 20% by volume of the mixture.

2. The kit of claim 1 wherein the mixture is further configured to be smoked through a pipe stem of the smoking pipe and out of a mouthpiece of the smoking pipe.

3. The kit of claim 2 wherein the bowl has a continuous exterior wall and a cavity centrally disposed within the exterior wall along a longitudinal midline thereof, wherein the bowl is configured to contain the mixture therein;

wherein the smoking pipe further comprises:

an aperture disposed through the exterior wall proximal to a bottom end thereof;

a cylindrical tube having a first end extending into the cavity and a second end:

an elongated cylindrical stem having a proximal end removably, slidably attached to the second end and a distal end;

a continuous opening centrally longitudinally disposed through the stem; and a hollow substantially cylindrical mouthpiece having an attachment end removably, slidably attached to the stem distal end and a tapered outer end.

4. The kit of claim 3 wherein the stem has a larger diameter than a diameter of the tube; and wherein the mouthpiece attachment end has a larger diameter than a diameter of the stem distal end.

5. The kit of claim 3 wherein the exterior wall of the pipe bowl comprises a plurality of first rectangles and a plurality of second rectangles thereon, each of the first rectangles having a smaller surface area than a surface area of a second rectangle;

wherein each of the first rectangles and the second rectangles are interspersed on the exterior wall;

wherein the interspersion of the first rectangles and the second rectangles on the exterior wall is configured to resemble a corn cob.

6. A non-addictive smoking composition and corn-cob pipe kit comprising:

a smoking pipe having a bowl;

a mixture of an amount of dried corn silk strands and an amount of dried corn cob leaves;

wherein the mixture is configured to be placed and lighted in the bowl of a smoking pipe and smoked therefrom through a pipe stem and out of a mouthpiece of the smoking pipe;

wherein the amount of dried corn silk strands is in a range of approximately 80% to 90% by volume of the mixture;

wherein the amount of dried corn cob leaves is in a range of 10% to 20% by volume of the mixture;

wherein the bowl has a continuous exterior wall and a cavity centrally disposed within the exterior wall along a longitudinal midline thereof, wherein the bowl is configured to contain the mixture therein;

wherein the smoking pipe further comprises:

an aperture disposed through the exterior wall proximal to a bottom end thereof;

a cylindrical tube having a first end extending into the cavity and a second end:

an elongated cylindrical stem having a proximal end removably, slidably attached to the second end and a distal end;

a continuous opening centrally longitudinally disposed through the stem;

a hollow substantially cylindrical mouthpiece having an attachment end removably, slidably attached to the stem distal end and a tapered outer end;

wherein the stem has a larger diameter than a diameter of the tube;

wherein the mouthpiece attachment end has a larger diameter than a diameter of the stem distal end;

wherein the smoking pipe comprises a corn-cob pipe;

wherein the exterior wall of the pipe bowl comprises a plurality of first rectangles and a plurality of second rectangles thereon, each of the first rectangles having a smaller surface area than a surface area of a second rectangle;

wherein each of the first rectangles and the second rectangles are interspersed on the exterior wall; and wherein the interspersion of the first rectangles and the second rectangles on the exterior wall is configured to resemble a corn cob.

* * * * *